US007946228B2

(12) United States Patent
Dindl et al.

(10) Patent No.: US 7,946,228 B2
(45) Date of Patent: May 24, 2011

(54) SELF CONTAINED NON TOXIC OBSCURANT GRENADE AND SELF-CONTAINED AEROSOL DISPERSING GRENADE

(76) Inventors: Frank J. Dindl, Newton, NJ (US); Laurence E Gainsborough, Winnipeg (CA); Wendy Gainsborough, legal representative, Winnipeg (CA)

( * ) Notice: Subject to any disclaimer, the term of this patent is extended or adjusted under 35 U.S.C. 154(b) by 497 days.

(21) Appl. No.: 12/151,912

(22) Filed: May 9, 2008

(65) Prior Publication Data

US 2010/0294157 A1 Nov. 25, 2010

(51) Int. Cl.
*F42B 12/46* (2006.01)
*A01G 13/06* (2006.01)

(52) U.S. Cl. ..... 102/368; 102/334; 47/2

(58) Field of Classification Search ..... 102/334, 102/367, 482, 487
See application file for complete search history.

(56) References Cited

U.S. PATENT DOCUMENTS

| | | | | | |
|---|---|---|---|---|---|
| 1,373,809 | A | * | 4/1921 | Hadaway, Jr. | 392/494 |
| 2,000,131 | A | * | 5/1935 | Goss | 102/368 |
| 2,076,308 | A | * | 4/1937 | Wells | 166/300 |
| 2,079,008 | A | * | 5/1937 | Goss | 102/368 |
| 2,094,561 | A | * | 9/1937 | Lowy | 102/368 |
| 2,882,239 | A | * | 4/1959 | Adams et al. | 47/2 |
| 2,959,127 | A | * | 11/1960 | Weinert | 102/368 |
| 3,238,143 | A | * | 3/1966 | Ainsley et al. | 102/334 |
| 3,584,194 | A | * | 6/1971 | Kautz et al. | 392/484 |
| 3,584,412 | A | * | 6/1971 | Palmer | 47/2 |
| 3,711,115 | A | * | 1/1973 | Lohr | 280/736 |
| 4,032,374 | A | * | 6/1977 | Douda et al. | 149/19.8 |
| 4,697,520 | A | * | 10/1987 | Brassert et al. | 102/334 |
| 4,732,085 | A | * | 3/1988 | Gershenson et al. | 102/334 |
| 4,846,112 | A | * | 7/1989 | Buford et al. | 122/21 |
| 5,154,782 | A | * | 10/1992 | Shaw et al. | 149/19.5 |
| 5,522,320 | A | * | 6/1996 | Dillehay | 102/334 |
| 6,037,032 | A | * | 3/2000 | Klett et al. | 428/71 |
| 6,087,935 | A | * | 7/2000 | Berner et al. | 340/541 |
| 6,253,680 | B1 | * | 7/2001 | Grubelich | 102/334 |
| 6,581,520 | B1 | * | 6/2003 | Koch et al. | 102/336 |
| 6,595,139 | B1 | * | 7/2003 | Haeselich | 102/498 |
| 7,275,486 | B2 | * | 10/2007 | Hsieh | 102/498 |

(Continued)

FOREIGN PATENT DOCUMENTS

DE 19642574 A1 * 7/1998

OTHER PUBLICATIONS (Eblen and Eblen, 1994, p. 185) Eblen, R. A. and Eblen W. (1994) The Encyclopedia of the Environment Houghton Mifflin Company, Boston.*

(Continued)

*Primary Examiner* — Michael Carone
*Assistant Examiner* — Richard L Norman, Jr.
(74) *Attorney, Agent, or Firm* — Townsend & Banta

(57) ABSTRACT

A self-contained grenade capable of dispersing a non-toxic obscurant composition, or various types of aerosol compositions such as pesticides or antimicrobial/sanitizing agents, is provided. The obscurant or other type of aerosol composition via an exothermic reaction. Release of the obscurant or other type of aerosol composition is effected in a controlled manner by creating heat via a heat producing composition comprising, for example, a thermite composition. The obscurant or other type of aerosol composition is absorbed into a heat transfer media disposed adjacent the heat producing composition. When the exothermic reaction occurs, the heat transfer media transfers the heat to the absorbed material, thereby providing a regulated thermal dispersion of same.

5 Claims, 1 Drawing Sheet

U.S. PATENT DOCUMENTS

| | | | | |
|---|---|---|---|---|
| 2003/0025077 | A1* | 2/2003 | Gainsborough | 250/330 |
| 2004/0232334 | A1* | 11/2004 | Gainsborough | 250/330 |
| 2005/0011651 | A1* | 1/2005 | Lell | 169/12 |
| 2006/0081483 | A1* | 4/2006 | Chen et al. | 206/7 |
| 2007/0017243 | A1* | 1/2007 | Kidwell et al. | 62/260 |
| 2008/0251215 | A1* | 10/2008 | Chen | 159/16.1 |
| 2009/0046824 | A1* | 2/2009 | Pomirleanu et al. | 376/236 |

OTHER PUBLICATIONS

Holman, J.P. (1986), Heat Transfer, 6th ed., McGraw-Hill, Inc. (New York).*

"Carbon foam has thermal conductivity equal to aluminum.(Brief Article)." Advanced Materials & Processes. ASM International. 2000. HighBeam Research. Oct. 28, 2010 <http://www.highbeam.com>.*

* cited by examiner

SELF CONTAINED NON TOXIC OBSCURANT GRENADE AND SELF-CONTAINED AEROSOL DISPERSING GRENADE

FIELD OF THE INVENTION

The present invention provides a self-contained grenade capable of dispersing a non-toxic obscurant composition, or various types of aerosol compositions such as pesticides or antimicrobial/sanitizing agents. In particular, the grenade of the present invention is designed to release an obscurant or other type of aerosol composition via an exothermic reaction. Release of the obscurant or other type of aerosol composition is controlled by providing a heat transfer media to act as a carrier for the obscurant composition or other type of aerosol composition, thereby regulating the thermal dispersion of same by the heat producing composition.

BACKGROUND OF THE INVENTION

Conventional pyrotechnic obscurant compositions have been provided which generate a dense primary particulate, such as inorganic oxides, or compounds which easily form atmospheric aerosols, such as hydrochloric acid, polyphosphates, or phosphoric acid. Further, conventional smoke grenades are well known, which disperse smoke via various types of chemical reaction. Although various smoke-producing compositions and devices are presently known, many such compositions are toxic.

In particular, most conventional smoke-producing compositions incorporate materials which are severely toxic, or are irritants when subjected to the heat necessary to produce smoke. Personnel anticipating exposure to such harmful smoke must protect themselves from the smoke. The problem of toxicity and irritation to people is clearly a limitation in several respects. Not only does it increase the potential for injury, but it may dictate the use of additional specialized equipment, such a respiratory protection. This type of equipment is expensive, and in, for example, training exercises, may detract from the ability to simulate actual conditions.

Additionally, most conventional smoke-producing compositions produce detrimental effects on equipment and supplies. For example, in addition to being toxic and irritating to people, conventional smoke-producing compositions are corrosive and damaging to both mechanical and electronic equipment. This is problematic, as smoke producers are usually employed in field operations which involve the use of precision electronic and mechanical equipment that may be damaged by the corrosive exhaust of such smoke-producing agents. Accordingly, the use of corrosive and damaging chemical compositions is a severe limitation for many known smoke compositions.

For military use, volatile hygroscopic chloride (HC) smokes are important for large scale operations. The most widely used HC type smoke-producing compositions are those resulting in the production of zinc chloride smokes. One example of a military HC smoke composition employs a reaction between hexachloroethane and zinc to produce zinc chloride. However, the reaction products are very toxic and believed to be carcinogenic.

Typical HC smokes have an obscuration index of about 200. Obscuration index is a dimensionless figure of merit for comparing the efficacy of smoke compositions. It compares the transmittance of electromagnetic radiation of a wavelength (or band of wavelengths) at a fixed smoke concentration and pathlength. The following equation, based upon Beer's Law, defines the transmittance of a smoke cloud as a function of mass extinction coefficient, concentration and path length:

$$T_\lambda(t)=e^{-\alpha Cl.}$$

where T=transmittance at some wavelength, $\lambda$
$\alpha$=extinction coefficient, in $m^2/g$,
C=smoke concentration in $g/m^3$, and
L=path length in m.

The transmittance is a function of both wavelength and time in a burning pyrotechnic.

Other effective smoke-producing compositions are based on phosphorus compounds (particularly red phosphorus) which form phosphoric acid in the atmosphere. Typical red phosphorus (RP) smokes have an obscuration index of about 4000. Although phosphorus smokes are highly effective, the smoke products are extreme irritants and are corrosive. This has led the United States Surgeon General to require the use of gas masks by persons exposed to such smokes. In addition, phosphorus reactions typically produce intense heat which is a further hazard and limitation of this type of material.

There have been recent efforts to develop low toxicity smoke compositions based on organic acids. For example, Douda et al. U.S. Pat. No. 4,032,374 discloses a low toxicity smoke composition based upon cinnamic acid for simulating fires and for training purposes. The cinnamic acid is volatilized by burning a mixture of potassium chlorate and sugar. Other low toxicity obscuring smokes based on aliphatic diacids are disclosed in Shaw et al. U.S. Pat. No. 5,154,782, which is incorporated herein by reference. In general, low toxicity smoke compositions based on organic acids have an obscuration index from about 120 to 140, approximately 60% of the screening power of HC smoke.

Current low toxicity smokes are useful for training purposes, but not for battlefield deployment. This requires the military agency to maintain a training round and a field use round of smoke-producing compositions. It would be a significant advancement in the art to provide low toxicity smoke generating compositions that can be used for both training and field deployment. Reduced inventory costs and ability to train troops in the same smoke environment that would be encountered on the battlefield would be an important advantage.

Further prior art dispersable materials, e.g. tear gas, are dispersed by various techniques. In one technique, the dispersable material is combined with a flammable material. Burning the combined materials vaporizes them, and they thereafter spread as a smoke cloud. In another technique, the dispersable material is packed with an explosive charge which detonates upon impact and causes the dispersable material to spread over an area.

The major shortcomings of these prior art techniques is that the combustion or explosion associated with each technique poses a fire or concussion hazard to buildings, property and people. Further, a container with slow burning contents can be picked up and thrown back at law enforcement personnel. Moreover, although unintentional, an exploding projectile can cause severe injury or even death.

Accordingly, it is an object of the present invention to provide a self-contained grenade capable of controllably dispersing a non-toxic obscurant composition via a thermal reaction.

It is a further object of the present invention to provide a self-contained grenade capable of controllably dispersing an aerosol composition via a thermal reaction.

SUMMARY OF THE INVENTION

In order to achieve the objects of the present invention, the present inventors earnestly endeavored to provide a self-contained grenade capable of safely and efficiently dispersing a non-toxic obscurant composition, or an aerosol composition. Accordingly, in a first embodiment of the present invention, a self-contained non-toxic obscurant grenade is provided comprising:

(a) a can having a base, a circumferential portion defining an interior and exterior portion, and a top, said top having a port therein;
(b) a heat source reaction chamber having an interior and exterior disposed in the in the interior of the can;
(c) a heat producing composition disposed within the heat source reaction chamber;
(d) heat transfer media disposed within the interior of the can, between the interior wall and the heat source reaction chamber;
(e) a non-toxic obscurant composition soaked into the heat transfer media;
(f) a grenade fuze assembly disposed adjacent the can top and/or through the can port.

In a second embodiment of the present invention, the self-contained non-toxic obscurant grenade of the first embodiment above is provided, further comprising (g) a ball valve assembly disposed within the heat source chamber, so as to be disposed in communication with the grenade fuze assembly In a third embodiment of the present invention, the self-contained non-toxic obscurant grenade of the first embodiment above is provided, wherein the heat producing composition is comprised of one or more thermite compositions.

In a fourth embodiment of the present invention, the self-contained non-toxic obscurant grenade of the first embodiment above is provided, wherein the heat transfer media is comprised of one or more of carbon foam, activated carbon, and metallic pellets or granules.

In a fifth embodiment of the present invention, the self-contained non-toxic obscurant grenade of the first embodiment above is provided, wherein the non-toxic obscurant composition is comprised of one or more of water, propylene glycol, glycerin, a mixture of glycerin and water, a mixture of propylene glycol and water, mineral oil, phosphoric acid, and diesel fuel.

In a sixth embodiment of the present invention, a self-contained aerosol agent dispersion grenade is provided comprising:

(a) a can having a base, a circumferential portion defining an interior and exterior portion, and a top, said top having a port therein;
(b) a heat source reaction chamber having an interior and exterior disposed in the in the interior of the can;
(c) a heat producing composition disposed within the heat source reaction chamber;
(d) heat transfer media disposed within the interior of the can, between the interior wall and the heat source reaction chamber;
(e) an aerosol-producing composition soaked into the heat transfer media; and
(f) a grenade fuze assembly disposed through the can port and into the ball valve assembly.

In a seventh embodiment of the present invention, the self-contained aerosol agent dispersion grenade of the sixth embodiment above is provided, further comprising (g) a ball valve assembly disposed within the heat source chamber.

In an eighth embodiment of the present invention, the self-contained aerosol agent dispersion grenade of the sixth embodiment above is provided, wherein the heat producing composition is comprised of one or more thermite compositions.

In a ninth embodiment of the present invention, the self-contained aerosol agent dispersion grenade of the sixth embodiment above is provided, wherein the heat transfer media is comprised of one or more of carbon foam, activated carbon, and metallic pellets or granules.

In a tenth embodiment of the present invention, the self-contained aerosol agent dispersion grenade of the sixth embodiment above is provided, wherein the aerosol-producing producing composition is comprised of one or more of a pesticide composition, antimicrobial composition, and sanitizing composition.

In an eleventh embodiment of the present invention, the self-contained non-toxic obscurant grenade of the first embodiment above is provided, further comprising an insulating material disposed on the interior of the heat source reaction chamber. For example, silicon dioxide (sand) can be used as an insulator to coat the interior surface of the heat source reaction chamber. The insulating material, such as sand, may be adhered to the interior of the heat source reaction chamber with an adhesive composition, such as a glue, epoxy, etc.

In a twelfth embodiment of the present invention, the self-contained aerosol agent dispersion grenade of the sixth embodiment above is provided, further comprising an insulating material disposed on the interior of the heat source reaction chamber. For example, silicon dioxide (sand) can be used as an insulator to coat the interior surface of the heat source reaction chamber. The insulating material, such as sand, may be adhered to the interior of the heat source reaction chamber with an adhesive composition, such as a glue, epoxy, etc.

DETAILED DESCRIPTION OF THE INVENTION

Figure 1:
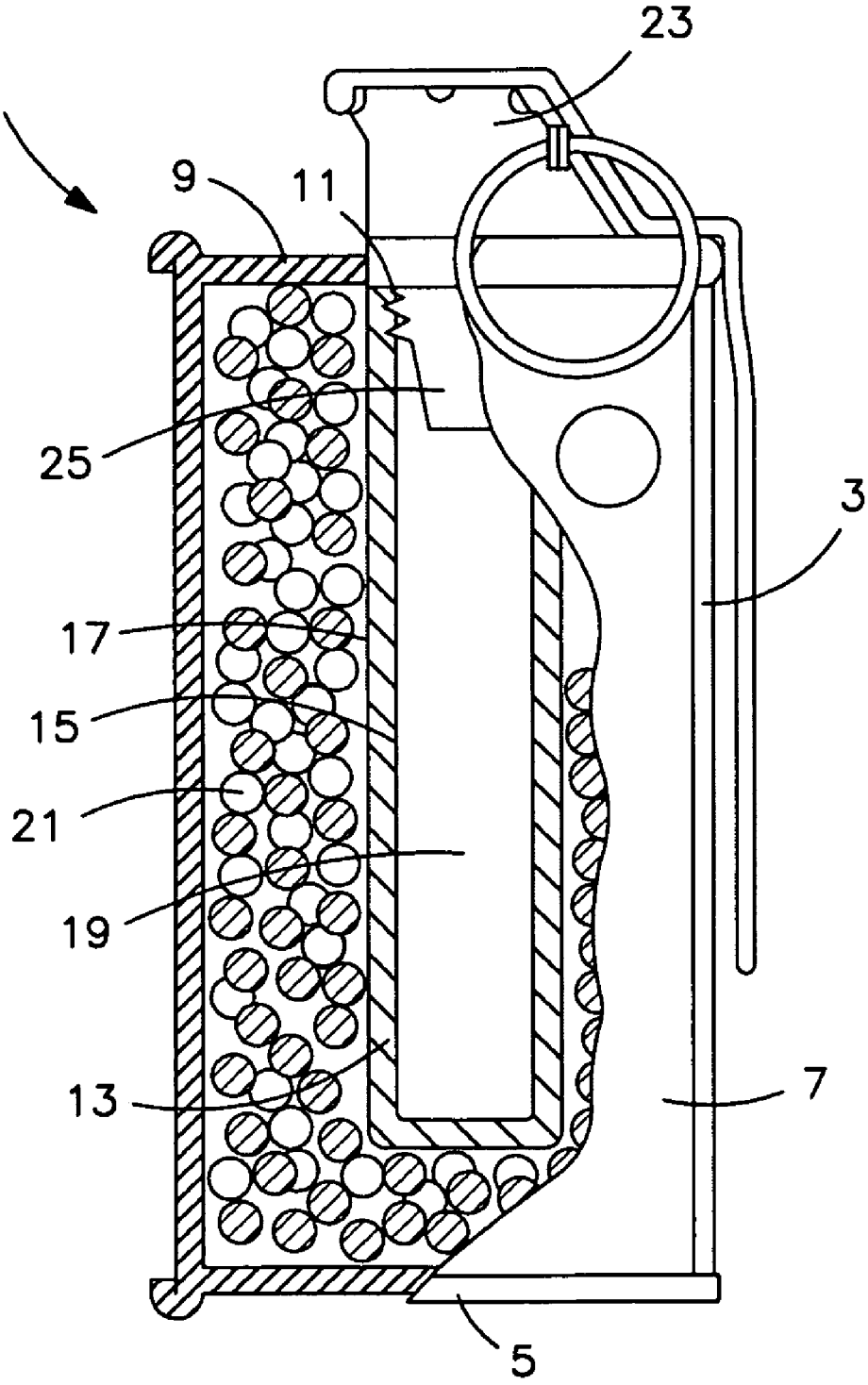
FIG. 1 is a partial cut away cross sectional view of the self-contained grenade of the present invention.

As illustrated in FIG. 1, the present invention provides a self-contained grenade 1. The self-contained grenade 1 is comprised of a can 3 which acts as the main structural component of the grenade. The can 3 has a base 5, a circumferential portion 7 defining an interior and exterior portion, and a top 9. The top 9 has a port 11 disposed therein.

As shown in FIG. 1, a heat source reaction chamber 13, having an interior 15 and exterior 17, is disposed in the interior of the can 3. The heat source reaction chamber 13 acts to encase the heat producing composition 19, which is disposed within the heat source reaction chamber 13.

The heat producing composition 19 is generally comprised of one or more thermite compositions. Thermite is generally comprised of an aluminum (al) powder with iron oxide powder. The reaction is extremely exothermic, wherein the two components react to produce aluminum oxide, elemental iron, and extreme heat. In the present invention, preferably, aluminum powder with black or blue iron oxide is used for the obscurant embodiment the grenade. Black or blue iron oxide ($Fe_3O_4$), produced by oxidizing iron in an oxygen-rich environment under high heat, is usually used as the thermite oxidizing agent because it is inexpensive and easily produced. As thermite doesn't produce a gas, there is no need to vent the reaction chamber, providing a high degree of storage safety, i.e., less potential for igniting a fire.

Further, it is preferably to provide the thermite components in fine particles, as the finer (smaller) particle size of the thermite components, the easier to ignite same. Alternatively, for the thermite component, aluminum powder with copper oxide (commonly used to create electrical joints in a process called cadwelding), or aluminum powder with chromium oxide, can be used.

Further, a heat transfer media 21 is disposed within the interior of the can, between the interior wall of the can 3 and the heat source reaction chamber 13. The heat transfer media is provided as a carrier for the obscurant or aerosol-producing composition. Preferably, the heat transfer media is comprised of one or more of carbon foam, activated carbon, and metallic pellets or granules. Alternatively, other materials capable of absorbing the obscurant composition or aerosol producing composition can be used, as long as it is capable of efficiently transferring heat to the obscurant composition or aerosol producing composition without interfering in the heat dispersion reaction necessary to disperse the agent of interest.

As mentioned above, and as called for in the first embodiment herein, a non-toxic obscurant composition is soaked into the heat transfer media 21. The non-toxic obscurant composition is preferably comprised of one or more of water, propylene glycol, glycerin, a mixture of glycerin and water, a mixture of propylene glycol and water, mineral oil, phosphoric acid, and diesel fuel. Alternatively, other non-toxic compositions could be used for the obscurant composition, as long as they are capable of being absorbed into the heat transfer media 21, and being dispersed via heating of the heat transfer media via the heat producing composition.

In an alternative embodiment, as called for in the sixth embodiment herein, the non-toxic obscurant composition is replaced with an alternative aerosol composition. For example, a pesticide composition, antimicrobial composition, and/or sanitizing composition may be soaked into the heat transfer media 21. Any pesticide composition, antimicrobial composition, and/or sanitizing composition may be utilized, as long as same is capable of being absorbed into the heat transfer media 21, and being dispersed via heating of the heat transfer media via the heat producing composition. For example, hydrogen peroxide, quaternary ammonium compounds, sodium hypochlorite, hypochlorous acid, and/or natural acids (such as citric acid, etc.), may be used as antimicrobials. With regards to pesticides, imithroprin, cypermethrin, tetramethrin, and/or bifenthrin may be used.

In order to initiate the heat producing reaction, a grenade fuze assembly 23 is disposed through the can port 11. The grenade fuze assembly may be any conventional fuze assembly capable of thermal initiation. A ball valve assembly 25 may further be provided, disposed within the heat source react chamber 13, and adjacent to the grenade fuze assembly. The ball valve assembly 25 prevents heat and gases being ejected from the grenade fuze assembly 23 (which would pose a safety hazard), and primarily confining the heat transfer to the fog producing composition. Thus, the grenade is provided with a means to safely and controllably allow the user to initiate the reaction.

Thermite burns at approximately 4000° F. ($FeO_2$—Al). But, the heat source reaction chamber, generally made of copper, melts at approximately 1200° F. Thus, there is a containment problem for the thermite. To overcome this, in a preferred embodiment, an insulating composition is glued on the interior of the thermite reaction chamber, so as to prevent the rapid melting of the heat source reaction chamber 13, the grenade fuze assembly 23 and ball valve assembly 25.

In particular, in a preferred embodiment, an insulating material is disposed on the interior of the heat source reaction chamber, so as to delay the heat transfer from the heat source reaction chamber to the interior of the can, and to prevent the heat producing composition from melting the. For example, silicon dioxide (sand) can be used as an insulator to coat a portion or all of the interior surface of the heat source reaction chamber, particularly adjacent the ball valve assembly. The insulating material, such as sand, may be adhered to the interior of the heat source reaction chamber with an adhesive composition, such as a glue, epoxy, etc.

In operation, a user activates (initiates) the grenade fuze assembly 23, usually by pulling a pin disposed therein. This action cause the grenade fuze assembly to initiate an igniter composition disposed therein, thereby initiating the thermite (heat producing composition) 19. The thermite burns rapidly, creating high heat within the heat source reaction chamber 13. The heat is rapidly transferred through the heat source reaction chamber 13, generally melting the thermite in the process, to the interior portion of the can 3.

As the heat permeates into the interior portion of the can 3, the heat transfer media 21, impregnated (soaked) with either a non-toxic obscurant composition, pesticide composition, antimicrobial composition, and/or sanitizing composition, is rapidly heated. Due to the properties of the heat transfer media, the heat is then rapidly transferred to the compositions described above. This intensity of heating causes rapid boiling of the compositions, causing the compositions to go from the liquid to the gas phase. As pressure and temperature increases within the can 3, the integrity of the can 3 is breached, via breaching of removably sealed vent holes (such as, for example, vent holes sealed with aluminum tape), allowing the rapid expulsion of the non-toxic obscurant composition, pesticide composition, antimicrobial composition, and/or sanitizing composition in gaseous phase. Specifically, the pressure in the can blows the seal off of the vent hole, allowing the rapid release of a fog of the above-listed compositions.

Preferably, the thermite is all consumed before the non-toxic obscurant composition, pesticide composition, antimicrobial composition, and/or sanitizing composition boils off. In such a case, there is no temperature spike when the non-toxic obscurant composition, pesticide composition, antimicrobial composition, and/or sanitizing composition is depleted. In order to achieve same, in a preferred embodiment, a ratio of thermite to non-toxic obscurant composition, pesticide composition, antimicrobial composition, and/or sanitizing composition solution is 1:1. In a more preferred embodiment, a ratio of 1:1.2 to 1:1.4 is used, to provide a safety factor. However, it should be noted that the ratio depends on the non-toxic obscurant composition, pesticide composition, antimicrobial composition, and/or sanitizing composition, i.e., the boiling point, etc., thereof.

TEST EXAMPLE

A self-contained non-toxic obscurant grenade was constructed according to the first embodiment above. In particular, a grenade was prepared containing 120 grams of thermite (as the heat producing composition). Further, as the insulating material, 10 grams of sand was disposed adjacent the top of the interior surface of the copper thermite reaction chamber (heat source reaction chamber), so as to insulate the ball valve assembly), and a coating of sand was adhered to the inner surface of the copper thermite reaction chamber wall and base. 75 grams of carbon foam was utilized as the heat transfer media, with 180 grams of fog solution consisting of equal parts water, propylene glycol, and glycerin soaked therein.

A conventional M201 grenade igniter assembly was utilized as the fuze assembly, containing 3 grams of thermite igniter mix ("first fire mixture" commonly used in thermite grenades). Upon initiation, fog production began within 5 seconds from pin pull. The majority of fog was produced within 45 seconds of pin pull, although the grenade continued to produce fog for an additional 45 seconds (90 seconds total). Peak temperatures at the outer surface of the grenade were measured to be 800° F. at the top and bottom of the grenade, and 550° F. along the circumference. All of the fog solution was driven out of the carbon foam by the end of the reaction.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

TABLE OF DRAWING ELEMENTS

1: self-contained grenade
3: can
5: base of can
7: circumferential portion of can
9: top of can
11: port
13: heat source reaction chamber
15: interior of heat source reaction chamber
17: exterior of heat source reaction chamber
19: heat producing composition
21: heat transfer media
23: grenade fuze assembly
25: ball valve assembly

What is claimed is:

1. A self-contained non-toxic obscurant grenade comprising:

(a) a can having a base, a circumferential portion defining an interior and exterior portion, and a top, said top having a port therein;

(b) a heat source reaction chamber having an interior and exterior disposed in the in the interior of the can;

(c) a heat producing composition comprised of one or more thermite compositions disposed within the heat source reaction chamber;

(d) heat transfer media comprised of one or more of carbon foam, activated carbon, and metallic pellets or granules disposed within the interior of the can, between an interior wall and an insulated metallic wall of the heat source reaction chamber;

(e) a non-toxic obscurant composition comprised of one or more of water, propylene glycol, glycerin, a mixture of glycerin and water, a mixture of propylene glycol and water, mineral oil, and phosphoric acid soaked into the heat transfer media;

(f) a grenade fuze assembly disposed adjacent the can top and/or through the can port;

wherein all of the thermite composition used is consumed before the non-toxic obscurant is boiled off or depleted, so as to prevent a temperature spike, and the thermite composition indirectly heats the non-toxic obscurant composition without mixing of combustion gases from thermite combustion with non-toxic obscurant.

2. The self-contained non-toxic obscurant grenade of claim 1, further comprising (g) a ball valve assembly disposed within the heat source chamber, so as to be disposed in communication with the grenade fuze assembly, thereby preventing heat and gases from being ejected from the grenade fuze assembly and primarily confining heat transfer to the non-toxic obscurant composition.

3. A self-contained aerosol agent dispersion grenade comprising:

(a) a can having a base, a circumferential portion defining an interior and exterior portion, and a top, said top having a port therein;

(b) a heat source reaction chamber having an interior and exterior disposed in the in the interior of the can;

(c) a heat producing composition comprised of one or more thermite compositions disposed within the heat source reaction chamber;

(d) heat transfer media comprised of one or more of carbon foam, activated carbon, and metallic pellets or granules disposed within the interior of the can, between an interior wall and an insulated copper wall of the heat source reaction chamber;

(e) an aerosol-producing composition comprised of one or more of a pesticide composition, antimicrobial composition, and sanitizing composition soaked into the heat transfer media; and (f) a grenade fuze assembly disposed through the can port and into a ball valve assembly disposed within the heat source chamber, wherein all of the thermite composition used is consumed before the aerosol-producing composition is boiled off or depleted, so as to prevent a temperature spike, and the thermite composition indirectly heats the aerosol-producing composition without mixing combustion products from the thermite with the aerosol-producing composition.

4. The self-contained non-toxic obscurant grenade of claim 1, wherein sand is used as the insulation on an interior wall of the heat source reaction chamber.

5. The self-contained aerosol agent dispersion grenade of claim 3, wherein sand is used as the insulation on an interior wall of the heat source reaction chamber.

* * * * *